United States Patent [19]

Washio et al.

[11] 4,361,395

[45] Nov. 30, 1982

[54] EXPOSURE ADJUSTMENT DEVICE FOR ELECTROSTATIC COPYING APPARATUS

[75] Inventors: Takaji Washio, Toyonaka; Masami Kai, Neyagawa, both of Japan

[73] Assignee: Mita Industrial Company Limited, Osaka, Japan

[21] Appl. No.: 172,282

[22] Filed: Jul. 25, 1980

[30] Foreign Application Priority Data

Jul. 28, 1979 [JP] Japan ..... 54-96237

[51] Int. Cl.[3] ..... G03G 15/00

[52] U.S. Cl. ..... 355/14 R; 355/14 C; 355/14 E; 355/67; 355/69

[58] Field of Search ..... 355/3 R, 14 R, 14 E, 355/67, 69, 70, 3 CH, 14 C

[56] References Cited

U.S. PATENT DOCUMENTS

| | | | |
|---|---|---|---|
| 3,771,867 | 11/1973 | Moser | 355/14 E |
| 3,989,374 | 11/1976 | Latka et al. | 355/67 X |
| 4,136,945 | 1/1979 | Stephens | 355/14 E |
| 4,153,364 | 5/1979 | Suzuki et al. | 355/14 E |

*Primary Examiner*—A. C. Prescott

*Attorney, Agent, or Firm*—Wenderoth, Lind & Ponack

[57] ABSTRACT

An exposure adjustment device for an electrostatic copying apparatus provides that electric power of an exposure lamp is controlled by pressing a key so as to cause copy density over a surface of a photoconductive member to be adjusted. The exposure lamp is energized electrically subsequent to change a of copy density from a set level to a standard level predetermined for obtaining an ordinary copy when a period predetermined by a timer elapses after copying operation finished and/or after the key is operated. This results in that the copy density of exposure is accomplished properly even if an operator forgets to adjust the copy density of exposure.

3 Claims, 5 Drawing Figures

EXPOSURE ADJUSTMENT DEVICE FOR ELECTROSTATIC COPYING APPARATUS

BACKGROUND OF THE INVENTION

1. Field of the Invention

The present invention relates to an exposure adjustment device to be used for an electrostatic copying apparatus for adjusting copy density over the surface of a photoconductive member, and more particularly to operation of a key for controlling the electric power of an energizing duration or the like of an exposure lamp.

2. Description of the Prior Art

In a conventional electrostatic copying apparatus, an exposure adjustment device for adjusting the copy density of exposure maintains a predetermined value adjusted before copying. Therefore, a copy intended to have a standard copy density tends to be reproduced under the condition that the copy density is more or less than that of the standard level. It is required to recognize or confirm and readjust the copy density of exposure for each copying operation.

SUMMARY OF THE INVENTION

To solve the foregoing shortcomings, there is provided an exposure adjustment device for an electrostatic copying apparatus wherein electric power of an exposure lamp is controlled by pressing a key so as to cause the copy density over a surface of a photoconductive member to be adjusted. The exposure lamp is energized electrically subsequent to change of copy density from a set level to a standard level predetermined for obtaining an ordinary the copy when a period predetermined by a timer elapses after a copy operation is completed and/or after the key is operated. Thereby the copy density is accomplished optimally, even if adjustment of the copy density is omitted carelessly.

Accordingly it is an object of the invention to provide an exposure adjustment device for an electrostatic copying apparatus.

It is another object of the invention to provide an exposure adjustment device for an electrostatic copying apparatus for preventing an ordinary copy from being reproduced with greater or lesser exposure, even if the key is not readjusted to a standard level after a copy operation is achieved under conditions that the copy density is greater or lesser than that of a standard level.

According to a preferred embodiment of the invention, copying preparation is complete when the copy density is maintained at a standard level upon closing a main switch.

According to another preferred embodiment of the invention, there is provided a ten key keyboard used for adjusting the copy density and for setting the number of copies to be made. This results in the operating portion of the copying apparatus being simplified.

In the preferred embodiment, there is provided an exposure adjustment device for an electrostatic copying apparatus wherein the number of copies is restored preset number when the copy density of exposure is set from another level which is different from the standard level to the standard level. In the case where the key is pressed consecutively after the key is pressed for adjusting the copy density, the operation for adjusting the copy density is changed to the operation for setting the number of copies.

For a better understanding of the present invention, together with other and further objects thereof, reference is made to the following description, taken in conjunction with the accompanying drawings, and the scope of the invention will be apparent from the appended claims.

BRIEF DESCRIPTION OF THE DRAWINGS

A detailed description of the invention will be made with reference to the accompanying drawings wherein like numerals designate corresponding parts in the various figures.

DETAILED DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best refined by the appended claims.

Figure 1:
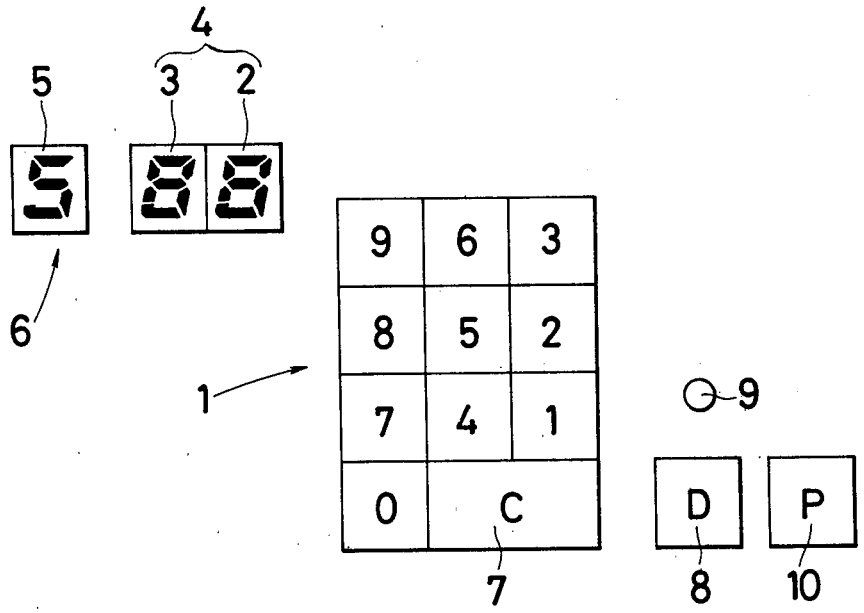
FIG. 1 is a front elevational view of an operating device mounted on a front portion of an electrostatic copying apparatus according to this invention.

FIG. 1 is a front elevational view of an operating device mounted on the front portion of a preferred embodiment of the invention. There is provided a ten key keyboard 1 to preselect a number of copies and to adjust the copy density of exposure. By pressing the keys of keyboard 1, it is possible to select a number of copies of two digits and to adjust copy density of exposure suitable for copying. Copy density is progressively adjustable corresponding to, respectively, numerals of the ten key keyboard 1 from "1" to "9." A central numeral "5" among numerals from "1" to "9" is set for a general standard level of copy density, i.e. the optimum level, in association with a normal copying operation. A number of copies is displayed on a copy paper amount display station 4 which comprises a display element 2 of the first order composed of segments of 7B fonts and a display element 3 of the second order composed of segments of 7B fonts. An adjustment level of copy density is displayed on an exposure display station 6 which comprises a display element 5 composed of segments of 7B fonts. When a power switch is closed, numeral "00" is displayed on the copy paper amount display station 4 and numeral "5" is displayed on the exposure display station 6. During a copying operation of copying an ordinary original document, a number of multiple copies to be made is set by pressing the appropriate keys of keyboard 1. Accordingly a number of copies of two digits is displayed on the copy paper amount display station 4. This value may be erased by pressing a clear button 7, and numeral "00" again will be displayed. In the case of a single copy, it is possible to reproduce a copy even though the copy paper amount display station 4 displays numeral "00." When the copy density of exposure is changed from numeral "5" to another numeral, the value corresponding to a numeral of the appropriate key of keyboard 1 is displayed on the exposure display station 6 by pressing the appropriate key of keyboard 1 and activating a lamp 9 by means of an exposure set button 8. The larger the numeral of the key of keyboard 1, chosen the thicker or greater is the copy density of exposure. Similarly, the smaller the numeral of the key of keyboard 1 chosen, the thinner or less is the copy density. When the keyboard 1 is operated as noted above and a print button 10 is also pressed, it is possible to make multiple copies in response to a preselected number of copies. During an ordinary copying operation, since numeral "5" is displayed normally on the exposure display station 6, it is not necessary to press either the exposure set button 8 or the keys of keyboard 1.

Figure 2:
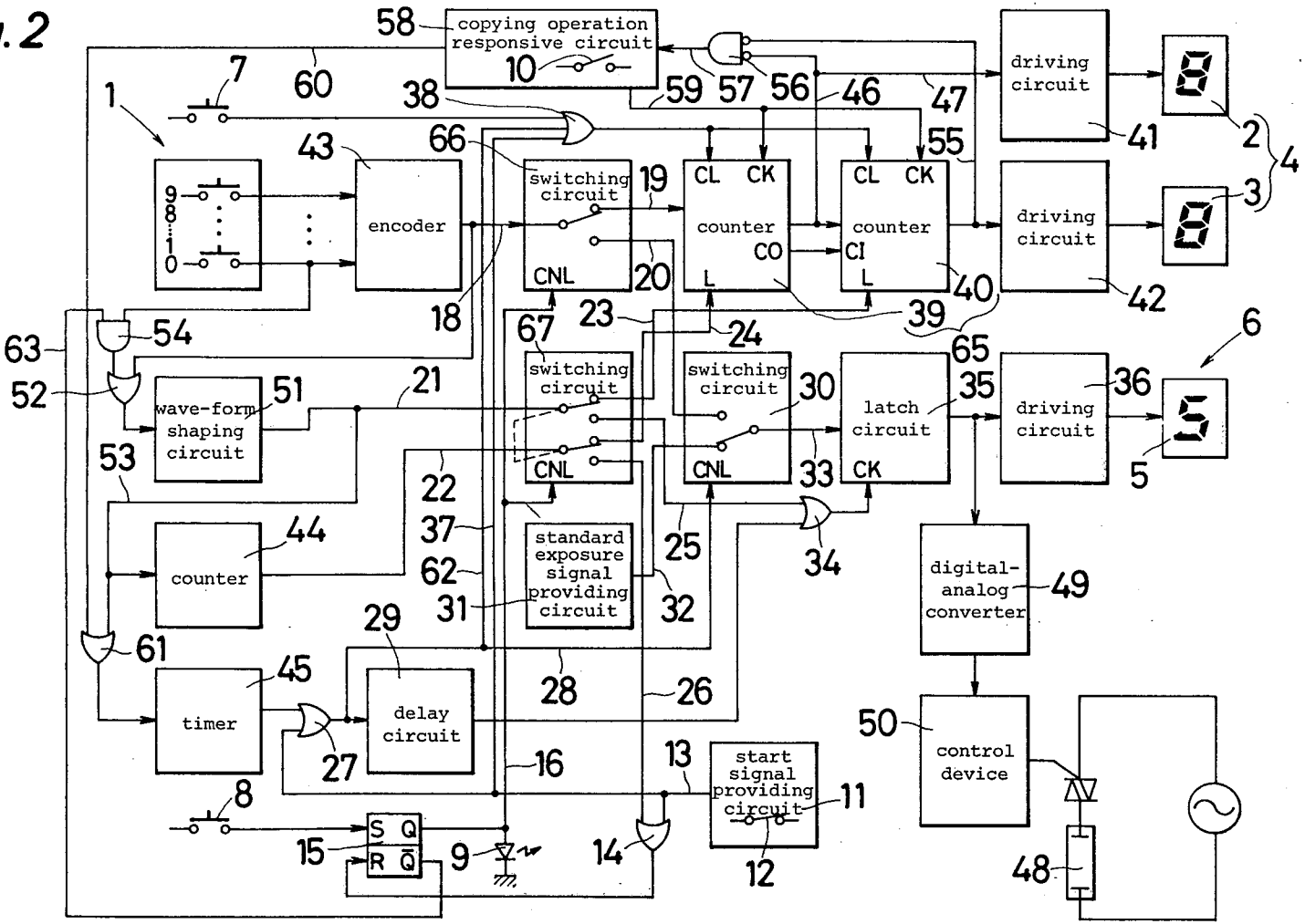
FIG. 2 is a schematic diagram of an electrical circuit to preset a number of copy paper sheets and to adjust copy density of exposure suitable for copying.
Figure 3:
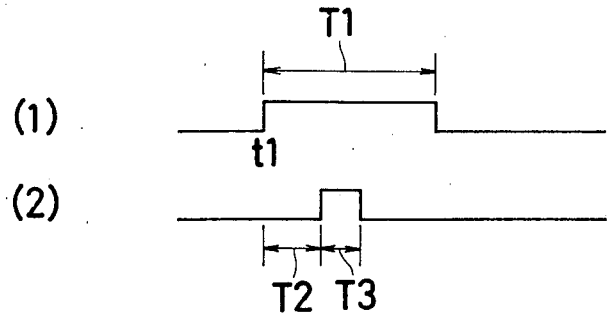
FIG. 3 is performance wave-form graph of a first delay circuit.

FIG. 2 is a schematic diagram of an electrical circuit to select a number of copies to be made and to adjust the copy density of exposure suitable for a particular copying operation. Operation of a delay circuit 29 representable by a one shot or the like is illustrated in FIG. 3. This delay circuit 29 produces a pulse which has a time period T3 after a time period T2 elapses from a time t1 as shown in FIG. 3 (2), when a signal having a time period T1 from time t1 is supplied to the input of the delay circuit 29 as shown in FIG. 3 (1). The time period is determined as follows: $(T2+T3)<T1$.

Figure 4:
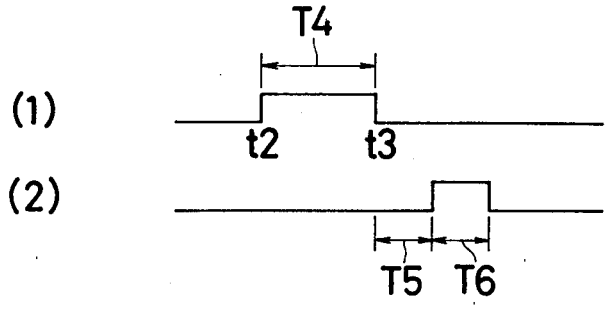
FIG. 4 is performance wave-form graph of a second delay circuit.

FIG. 4 is performance wave-form graph of a delay circuit 44 including a one shot or the like as shown in FIG. 2. This delay circuit 44, whose signal has a time period T4 from a time t2. produces a pulse which is maintained for a time period T6 after a time period T5 elapses from a time t3.

Figure 5:
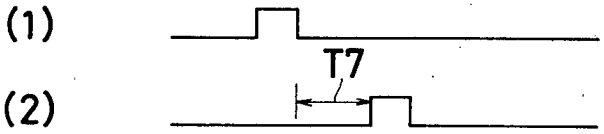
FIG. 5 is performance wave-form graph of a timer.

FIG. 5 is performance wave-form graph of a timer 45 included in FIG. 2. The timer 45 produces a pulse having a wave-form as shown in FIG. 5 (2), when a pulse of a wave-form shown in FIG. 5 (1) is supplied. If a time period of the timer 45 is determined as T7 (for example about 2~3 minutes) and the input pulse is not applied within the preceding time period T7 from the last input pulse, the timer 45 produces a pulse over the time period T7.

Referring to FIG. 2, a start signal providing circuit 11 in response to a main switch 12 of the copying apparatus provides a single pulse when the main switch 12 is turned on. Upon closing the main switch 12, i.e. when electric power is supplied, the apparatus is in a state of preparation for copying. The pulse from the start signal providing circuit 11 is applied via line 13 to an OR gate 14. A signal from the OR gate 14 resets a flip-flop 15, accordingly a signal of logic "0" is applied as set outputs of the flip-flop 15, and the set outputs are connected through line 16 to input terminals CNL of switching circuits 66 and 67. The switching circuit 66 serves to connect an input line 18 to an output line 19 when the terminal CNL receives a signal of logic "0," and to connect the input line 18 to an output line 20 when the terminal CNL receives a signal of logic "1." The switching circuit 67 serves to connect input lines 21 and 22 to output lines 23 and 24 respectively when the terminal CNL receives a signal of logic "0," and to connect the input lines 21 and 22 to output lines 25 and 26 respectively when the terminal CNL receives a signal of logic "1." Therefore, upon closing a power switch, outputs of switching circuits 66 and 67 are connected to the inputs of a copy paper amount set circuit 65 including counters 39 and 40.

The pulses from the start signal providing circuit 11 are applied via line 13, line 37 and an OR gate 38 to each clear terminal CL of the counters 39 and 40. The counter 39, for serving to preset or store a numeral of first order, stores a data information from line 19 when the input of a load terminal L receives a signal, clears the stored information when the input of a clear terminal CL receives a signal, and reduces by one a stored number when the terminal CK receives a signal. The counter 40, for serving to preset or store a numeral of second order, stores the data information transferred from the counter 39 when the terminal L receives a signal, clears the preceding stored information when the terminal CL receives a signal, and reduces by one a stored number when the terminal CK receives a signal and a pulse is applied from the terminal CO of the counter 39 to the terminal CI. The counter 39 produces a single pulse from the terminal CO when the stored number becomes "0."

When the terminal CL of the counter 39 receives a signal to clear the stored information, correspondingly the display element 2 of first order displays numeral "0" through lines 46 and 47 and a driving circuit 41. The display element 3 of second order displays numeral "0" through the counter 40 and a driving circuit 42. Therefore when a power switch is closed, numeral "00" is displayed on the copy paper amount display station 4.

The output signal from line 13 through an OR gate 27 to line 28 is coupled to the input terminal CNL of a switching circuit 30. In the switching circuit 30, when a signal of logic "1" is supplied to the input terminal CNL of the switching circuit 30, an input line 32 connected to a standard exposure signal providing circuit 31, which provides a signal to derive a predetermined standard copy density of exposure, is connected to output line 33, and when a signal of logic "0" is supplied to the input terminal CNL, line 20 is connected to line 33. Delay circuit 29 which receives a signal from the OR gate 27 produces a pulse after the time period T2 elapses as shown in FIG. 3. The pulse is applied via an OR gate 34 to the input terminal CK of a latch circuit 35. The latch circuit 35 has a function storable to recognize a parallel signal of four bits when the terminal CK receives a signal. Therefore, due to the delay circuit 29, a signal is delayingly supplied to the input terminal CK of the latch circuit 35, correspondingly a parallel signal of four bits supplied from the standard exposure signal providing circuit 31 is substantially supplied and stored in the latch circuit 35 via line 32, the switching circuit 30 and line 33. The information indicating standard copy density of exposure, which is stored in the latch circuit 35, is displayed as numeral "5" via a driving circuit 36 on the display element 5 of the exposure display station 6. Simultaneously the stored information of the latch circuit 35 is converted into an analog signal by a digital-analog converter 49, then the analog signal is supplied to the input of a control device 50, which controls the energizing duration of an exposure lamp 48 in response to a signal from the digital-analog converter 49. Thereby, copy density of exposure is adjusted to a standard level corresponding to numeral "5" of the exposure display station 6.

By pressing the appropriate key of keyboard 1, a signal of logic "1" is supplied to the input of an encoder 43. The encoder 43 provides a binary signal of four bits corresponding to a numeral identified by the pressed key of keyboard 1.

To select a desired number of copies, first a suitable key of keyboard 1 for a number of the second order is pressed. The resultant parallel signal of four bits from the encoder 43 is supplied via line 18 the switching circuit 66 and line 19, to the input counter 39. A signal from the pressed key of the keyboard 1 for displaying numeral "0" is supplied to one input terminal of an AND gate 54. At this time the other input terminal of the AND gate 54 receives a reset output signal of logic "1" from the flip-flop 15 through line 63. A signal from the pressed key of the keyboard 1 is supplied via the AND gate 54 to one input terminal of an OR gate 52. A parallel signal of four bits from the encoder 43 is supplied to the other input terminal of the OR gate 52. The output signal from the OR gate 52 is supplied to the input of a wave-form shaping circuit 51 of a one shot or the like to shape its wave-form, and the output signal from the wave-form shaping circuit 51 is supplied via line 21, the switching circuit 67 and line 23 to the input of the terminal L of the counter 40. Therefore a parallel signal of four bits from line 19 is transferred from the counter 39 and stored in the counter 40. The data information stored in the counter 40 is displayed via the driving circuit 42 on the display element 3 of second order. A signal from the wave-form shaping circuit 51 is supplied via line 53 shunted from line 21 to the input of the delay circuit 44. Accordingly the delay circuit 44 produces a pulse which is delayed for the time period (T4+T5) from the input time t2 shown in FIG. 4, the pulse is supplied via line 22, the switching circuit 67 and line 24 to the input terminal L of the counter 39. Secondly, by pressing a suitable key of the keyboard 1 for a numeral of the first order, the signal from such key is converted to a parallel signal of four bits by the encoder 43, and is supplied via line 18 and the switching circuit 66 to line 19. The counter 39 receives a signal on the input terminal L and hence stores the data information from line 19. The stored information is transferred via lines 46 and 47 to the driving circuit 41. Consequently a numeral of first order is displayed on the display element 2.

Signals from the encoder 43 and numeral "0" of the pressed keys of keyboard 1 are supplied via the OR gate 52, the wave-form shaping circuit 51 and line 53 to the input of the timer 45. By pressing any of the ten keys, the timer 45 is enabled to commence a time counting operation.

If an incorrect key is mistakenly pressed to select an incorrect number of copies, the clear button 7 is pressed. Accordingly a signal from the clear button 7 through the OR gate 38 is supplied to each terminal CL of the counters 39 and 40 so as to clear the information stored in the counters 39 and 40. Then a correct numeral is stored in the counters 39 and 40 by repressing the keys of keyboard 1 accurately as above-mentioned, and the numeral concerned is displayed on the copy paper amount display station 4.

After the operation for setting the number of copies has been finished, a print button 10 in a copying operation responsive circuit 58 is pressed within about 2–3 minutes. Accordingly it is possible to provide multiple copies by setting a desired number of copies. The copying operation responsive circuit 58 produces a signal of logic "1" to line 60 during a copying operation, and a signal of logic "0" to line 60 after completion of the copying operation. Therefore by pressing the print button 10, a signal of logic "1" is applied via line 60 and the OR gate 61 to the timer 45. After pressing the appropriate key of keyboard 1, since a signal of logic "1" is applied in the time period T7 (about 2–3 minutes) of the timer 45, the timer 45 does not produce a pulse. On the contrary, the timer 45 produces a pulse over the time period T7, which is supplied to each input terminal CL of the counters 39 and 40 to clear the stored information of the counters 39 and 40. Correspondingly, numeral "00" is displayed on the copy paper amount display station 4. The number of copies may be reset again by pressing the appropriate keys of keyboard 1.

During a copying operation, the copying operation responsive circuit 58 produces a single pulse to line 59 during every copying step. Then the number of first order stored in the counter 39 is reduced one by one whenever a signal is applied from line 59 to the input terminal CK. When the numeral of first order becomes "0," the single pulse is applied from the output terminal CO of the counter 39 to the terminal CI of the counter 40. Correspondingly, the number stored in the counter 40 is reduced by one in response to the pulse from line 59. Consequently the amount of copies displayed on the copy paper amount display station 4 is reduced progressively one by one upon every copying step. When the numerals of both first and second orders become "0," an INVERT-AND gate 56 receiving a signal from lines 46 and 55 produces a signal of logic "1" to line 57. When a signal of logic "1" is applied to the copying operation responsive circuit 58, the copying operation of the electrostatic copying apparatus stops.

Assume that the copy density of exposure is changed from a standard level specified by numeral "5" to another level specified by numeral "9." In this case, the exposure set button 8 may be pressed after setting the number of copies as above-mentioned. The flip-flop 15 is set and the set output signal of logic "1" is applied to each input terminal CNL of the switching circuits 66 and 67. In the switching circuit 66, line 18 is coupled to line 20. In the switching circuit 67, lines 21 and 22 are coupled to lines 25 and 26 respectively. A lamp 9 is then turned on. By pressing numeral "9" of the ten key keyboard 1, the signal from the keyboard 1, which is applied to the encoder 43 to be converted to a parallel signal of four bits, is supplied via line 18 and the switching circuit 66 to line 20. Then since the input terminal CNL of the switching circuit 30 receives a signal of logic "0," line 20 is coupled to line 33. A signal from the encoder 43 is applied via the OR gate 52, the waveform shaping circuit 51, line 21, the switching circuit 67, line 25 and the OR gate 34 to the input terminal CK of the latch circuit 35. Accordingly a parallel signal of four bits on line 20 is supplied and stored in the latch circuit 35 via the switching circuit 30 and line 33. At this time numeral "9" is displayed via the driving circuit 36 on the display element 5 of the exposure display station 6. The signal is applied via the digital-analog converter 49 to the control device 50, which controls the energizing duration to adjust the copy density of exposure correspond to numeral "9."

By pressing the exposure set button 8, the flip-flop 15, which remains to be set, supplies a reset output signal of logic "0" via line 63 to one input terminal of AND gate 54. Therefore even should numeral "0" of the keyboard is pressed, neither will the exposure display station 6 display numeral "0" nor will the copy density of exposure be at a zero level.

A signal which is shaped through the wave-form shaping circuit 51 is applied via line 53 to the input of the delay circuit 44. Correspondingly, the delay circuit 44 produces a pulse which is delayed for the time period (T4+T5) as shown in FIG. 4, which resets the flip-flop 15 through line 22, the switching circuit 67, line 26 and OR gate 14. Therefore, a signal of logic "0" is supplied to each input terminal CNL of the switching circuits 66 and 67, and at the same time, the lamp 9 is turned off. When a signal of logic "0" is supplied to each input terminal CNL of the switching circuits 66 and 67, the switching circuits 66 and 67 are changed to the copy paper amount set circuit 65 composed of the counters 39 and 40. A signal on line 53 is supplied via the OR gate 61 to the input of the timer 45 so as to clear the timer 45. Hereby if the print button 10 is pressed within the time period T7 of the timer 45, a signal of logic "1" is supplied via the copying operation responsive circuit 58, line 60 and the OR gate 61 to the timer 45. Therefore the timer 45 does not produce a pulse.

Multiple copies of the preset number of copies are continuously achieved by pressing the print button 10. The time between each copying step is less than the time period T7 of the timer 45. After a copying operation has been finished, a signal of logic "0," which is applied from the copying operation responsive circuit 58 to line 60, is applied via the OR gate 61 to the input of the timer 45. Accordingly the timer 45 produces a pulse when the time period T7 of the timer 45 elapses after finishing of a copying operation. Accordingly line 32 is coupled to line 33 in the switching circuit 30. Therefore the data information from the standard exposure signal providing circuit 31 is stored in the latch circuit 35, and numeral "5" is displayed on the exposure display station 6. The energizing duration of the exposure lamp 48 is controlled in response to the standard copy density of exposure. A pulse from the timer 45 is applied via line 62 and the OR gate 38 to each input terminal CL of the counters 39 and 40 to clear the counters 39 and 40.

After the appropriate key of keyboard 1 is pressed for adjusting the copying density of exposure, assume that the print button 10 is not pressed within the time period T7 of the timer 45. In this case, the timer 45 produces a pulse after the time period T7, accordingly numeral "5" is displayed on the exposure display station 6 and numeral "00" is displayed on the copy paper amount display station 5.

When an incorrect key of keyboard 1 is pressed after pressing the exposure set button 8, the exposure set button 8 is repressed to set the flip-flop 15, and a correct key of the ten key keyboard 1 is pressed again.

It makes no difference which operation is achieved first, for setting the number of copies or for adjusting the copy density of exposure.

In the illustrated embodiment of this invention, the operating portion of the electrostatic copying apparatus is simplified because the ten key keyboard 1 is utilized both to set the number of copies and to adjust the copy density of exposure.

According to another aspect of this invention, a micro computer may replace the circuit as shown in FIG. 2.

What is claimed is:

1. An adjustment device, for use in an electrostatic copying apparatus to make copies of an original, for selectively setting the number of copies to be made during a particular copying operation of the apparatus, and for selectively adjusting the electrical energization of an exposure light source of the apparatus, thereby to adjust the copy density of exposure during the copying operation, said adjustment device comprising:

keyboard means for, in one input mode, inputting a selected number of copies to be made during the particular copying operation of the electrostatic copying apparatus, and for, during another input mode, inputting a selected copy density of exposure value, said keyboard means adapted to be connected to the electrostatic copying apparatus such that the apparatus conducts the copying operation to make said selected number of copies at said selected copy density of exposure value;

change-over switch means for switching said keyboard means between said one and another input modes;

latch circuit means, operatively connected to said keyboard means when in said another input mode for storing an electrical first signal representative of said selected copy density of exposure value, and adapted to be connected to the exposure light source of the apparatus for transferring said first signal thereto for controlling the electrical energization thereof;

copying operation responsive control circuit means, adapted to be responsive to the completion of the copying operation, for generating an electrical second signal representative thereof; and timer means for receiving said second signal from said control circuit means and for, after the lapse of a predetermined period of time, releasing said first signal representative of said selected copy density of exposure value from said latch circuit means and storing therein an electrical third signal representative of a standard copy density of exposure value.

2. A device as claimed in claim 1, further comprising:

counter means connected to said keyboard means when in said one input mode for storing an electrical fourth signal representative of said selected number of copies;

said control circuit means including means for generating an electrical fifth signal representative of the completion of each copy of said selected number of copies during the copying operation and for supplying said fifth signal to said counter means for altering said fourth signal stored therein to reduce said number by one;

standard exposure signal providing circuit means for generating said third signal;

generating means for generating an electrical sixth signal representative of change-over of said keyboard means from said one input mode to said another input mode;

first and second switching circuit means;

said first switching circuit means being operable when said keyboard means is in said one input mode for transferring said fourth signal from said keyboard means to said counter means, and said first switching circuit means being responsive to said sixth signal, during said another input mode of said keyboard means, for transferring said first signal from said keyboard means through said second switching circuit means to said latch circuit means; and said second switching circuit means being operable in response to said timer means, after said predetermined period of time, for transferring said third signal from said standard exposure signal providing circuit means to said latch circuit means.

3. A device as claimed in claim 2, wherein said change-over switch means and said generating means comprise a flip-flop connected to a main switch of the apparatus and having first and second stable states generating respectively said sixth signal and an electrical seventh signal, and exposure set means connected to said flip-flop and having a first operative condition for setting said flip-flop in said first stable state and thereby for supplying said sixth signal to said first switching circuit means, and said exposure set means having a second operative condition for setting said flip-flop in said second stable state and thereby supplying said seventh signal to said first switching circuit means to enable said first switching circuit means to transfer said fourth signal from said keyboard means to said counter means.

* * * * *